US006381336B1

(12) United States Patent
Lesinski et al.

(10) Patent No.: US 6,381,336 B1
(45) Date of Patent: Apr. 30, 2002

(54) MICROPHONES FOR AN IMPLATABLE HEARING AID

(76) Inventors: S. George Lesinski, 324 Bishopbridge Dr., Cincinnati, OH (US) 45225; Arnand P. Neukermans, 3510 Srbutus Ave., Palo Alto, CA (US) 94303

( * ) Notice: Subject to any disclaimer, the term of this patent is extended or adjusted under 35 U.S.C. 154(b) by 0 days.

(21) Appl. No.: 09/261,278

(22) Filed: Mar. 2, 1999

Related U.S. Application Data

(62) Division of application No. 08/862,874, filed on May 23, 1997, now Pat. No. 5,881,158.

(60) Provisional application No. 60/018,299, filed on May 24, 1996.

(51) Int. Cl.[7] ..... H04R 25/00

(52) U.S. Cl. ..... 381/326; 381/322; 600/25; 607/57; 181/129

(58) Field of Search ..... 381/173, 174, 381/322, 326, 328, 380; 600/25; 607/55–57; 181/128–130, 134, 135

(56) References Cited

U.S. PATENT DOCUMENTS 5,897,486 A * 4/1999 Ball et al. ..... 600/25
5,949,895 A * 4/1999 Ball et al. ..... 381/322
6,068,589 A * 3/2000 Neukermans ..... 600/25

* cited by examiner

*Primary Examiner*—Curtis Kuntz
*Assistant Examiner*—Suhan Ni
(74) *Attorney, Agent, or Firm*—D. E. Schreiber

(57) ABSTRACT

A implantable sealed microphone (50) includes a diaphragm (52) having a thin central region (54) surrounded by a thicker rim (56). One side of sheet electret material (72) is bonded to the diaphragm (52) while the other side contacts a roughened plate (82). The rim (56) is bonded to a housing (112) thereby hermetically enclosing the electret (72) and the plate (82). The microphone (50) also includes an electrical connector (94) that couples both the plate (82) and the electret (72) to an input of an amplifier (30) included in an implantable hearing aid system (10). Preferably, the microphone (50) is incorporated into a sealed electronics module (100) together with the amplifier (30) and an energy storage device such as a battery that energizes operation of the implantable hearing aid system (10). In such a configuration, the microphone's diaphragm (52) forms a surface of the electronics module's housing (112). An electrical connector (134) couples an output signal from the amplifier (30) to a microactuator (32) of the implantable hearing aid system (10).

16 Claims, 7 Drawing Sheets

MICROPHONES FOR AN IMPLATABLE HEARING AID

CLAIM OF PROVISIONAL APPLICATION RIGHTS

This application claims the benefit of United States Provisional Patent Application Ser. No. 60/018,299 filed on May 24, 1996 and is a division of application Ser. No. 08/862,874 filed May 27, 1997 which issued Mar. 9, 1999, as U.S. Pat. No. 5,881,158.

BACKGROUND OF THE INVENTION

1. Field of the Invention

The present invention relates to fully implantable hearing aid system, and more particularly to an electret microphone adapted for use in such fully implantable hearing aid systems, and how such an electret microphone or other type of microphone may be incorporated into the fully implantable hearing aid system.

2. Description of the Prior Art

Patent Cooperation Treaty ("PCT") patent application Ser. No. PCT/US96/15087 filed Sep. 19, 1996, entitled "Implantable Hearing Aid" ("the PCT Patent Application") describes a fully implantable hearing aid system which uses a very small implantable microactuator. The PCT Patent Application also discloses a Kynar® microphone which may be physically separated far enough from the implanted microactuator so that no feedback occurs. The fully implantable hearing aid system disclosed in the PCT Patent Application can operate for a period of five years on a set of batteries, and produce sound levels of 110 dB. The fully implantable hearing aid system described in the PCT Patent Applications is extremely compact, sturdy, rugged, and provides significant progress towards addressing problems with presently available hearing aids.

While the Kynar microphone disclosed in the PCT Patent Application enables an operable fully implantable hearing aid system, that system's performance may be improved through the use of a more sensitive electret microphone. U.S. Pat. Nos. 4,947,478 ("the '478 patent") and 5,015,225, a division of the '478 patent, disclose incorporating a conventional electret microphone into an outer ear canal unit 34 of a partially implantable hearing aid system. U.S. Pat. No. 5,408,534 entitled "Electret Microphone Assembly, and Method of Manufacture" discloses an improved structure and method for coupling a charge plate of the electret microphone used in a hearing aid to an input terminal of an impedance matching circuit or internal amplifier. One difficulty with using an electret microphone for a fully implantable hearing aid system not addressed by the patents identified above is that the microphone must be hermetically sealed to prevent electret de-polarization while simultaneously permitting sound waves to impinge upon the microphone.

Because the hearing aid system disclosed in the PCT Patent Application is fully implanted, it is presently estimated that after a five year interval of use the system's battery may likely need replacement which necessarily involves surgery. Another aspect of a fully implantable hearing aid system is ensuring reliable electrical interconnection of the system's microphone and microactuator to the system's signal-processing amplifier throughout a five year interval prior to battery replacement, and subsequently after the battery has been replaced.

SUMMARY OF THE INVENTION

An object of the present invention is to provide an electret microphone adapted for incorporation into a fully implantable hearing aid system.

Another object of the present invention is to provide a simpler fully implantable hearing aid system.

Another object of the present invention is to provide a fully implantable hearing aid system which incorporates the microphone into an implanted housing that contains the hearing aid's amplifier and battery.

Another object of the present invention is to provide an improved structure for implanting a housing enclosing a fully implantable hearing aid's amplifier and battery into a depression surgically sculpted in a subject's mastoid cortical bone.

Another object of the present invention is to provide a structure for a fully implantable hearing aid's housing that encloses an amplifier and battery which provides ready tactile access to hearing aid operating controls.

Briefly, the present invention includes a sealed microphone adapted for inclusion in an implantable hearing aid system. The sealed implantable microphone provides an input signal to an amplifier included in the implantable hearing aid system. The microphone includes a diaphragm having a thin central region surrounded by a thicker rim. An electret, which is bonded to the diaphragm, contacts a roughened plate included in the microphone. The rim of the diaphragm is bonded to a surface of a housing to hermetically enclose the electret and the plate, the plate being electrically insulated from the housing. The microphone also includes an electrical connector coupled both to the plate and through the housing to the electret for providing the input signal to the amplifier of the implantable hearing aid system.

This implantable microphone is preferably incorporated into a hermetically sealed electronics module. In addition to the microphone, the electronics module includes an amplifier that receives the input signal from the microphone's plate and the electret, and provides an output signal to a microactuator also included in the implantable hearing aid system. The electronics module also includes a battery for energizing operation of the implantable hearing aid system. A housing for the electronics module receives the battery, the amplifier, the plate, and the electret. The microphone's diaphragm forms a surface of the housing with the rim of the diaphragm being bonded to the housing thereby hermetically sealing the electronics module. An electrical connector coupled to the amplifier provides the output signal to the microactuator of the implantable hearing aid system.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

I The Overall System

Figure 1:
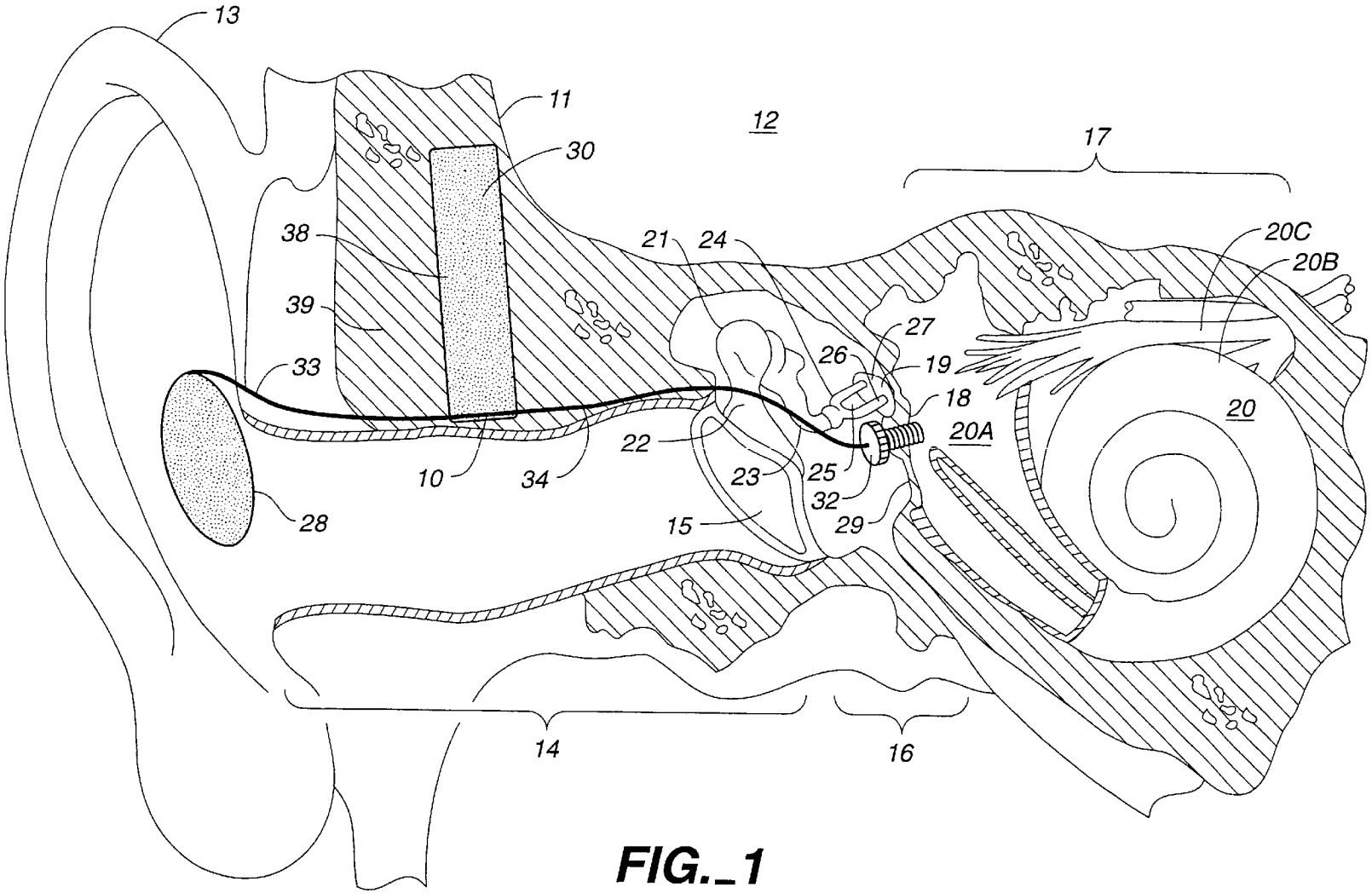
FIG. 1 is a schematic coronal, partial sectional view through a human temporal bone illustrating the external, middle and inner ears, and showing the relative positions of the components of a fully implantable hearing aid system disclosed in the PCT Patent Application.

FIG. 1 illustrates relative locations of components of a fully implantable hearing aid 10 after implantation in a temporal bone 11 of a human subject 12. FIG. 1 also depicts an external ear 13 located at one end of an external auditory canal 14, commonly identified as the ear canal. An opposite end of the external auditory canal 14 terminates at an ear drum 15. The ear drum 15 mechanically vibrates in response to sound waves that travel through the external auditory canal 14. The ear drum 15 serves as an anatomic barrier between the external auditory canal 14 and a middle ear cavity 16. The ear drum 15 amplifies sound waves by collecting them in a relatively large area and transmitting them to a much smaller area of an oval-shaped window 19. An inner ear 17 is located in the medial aspects of the temporal bone 11. The inner ear 17 is comprised of otic capsule bone containing the semi-circular canals for balance and a cochlea 20 for hearing. A relatively large bone, referred to as the promontory 18, projects from the otic capsule bone inferior to the oval window 19 which overlies a basal coil of the cochlea 20. A round window 29 is located on the opposite side of the promontory 18 from the oval window 19, and overlies a basal end of the scala tympani.

Three mobile bones (malleus, incus and stapes), referred to as an ossicular chain 21, span the middle ear cavity 16 to connect the ear drum 15 with the inner ear 17 at the oval window 19. The ossicular chain 21 conveys mechanical vibrations of the ear drum 15 to the inner ear 17, mechanically de-amplifying the motion by a factor of 2.2 at 1000 Hz. Vibrations of a stapes footplate 27 in the oval window 19 cause vibrations in perilymph fluid 20A contained in scala vestibuli of the cochlea 20. These pressure wave "vibrations" travel through the perilymph fluid 20A and endolymph fluid of the cochlea 20 to produce a traveling wave of the basilar membrane. Displacement of the basilar membrane bends "cilia" of the receptor cells 20B. The shearing effect of the cilia on the receptor cells 20B causes depolarization of the receptor cells 20B. Depolarization of the receptor cells 20B causes auditory signals to travel in a highly organized manner along auditory nerve fibers 20C, through the brainstem to eventually signal a temporal lobe of a brain of the subject 12 to perceive the vibrations as "sound."

The ossicular chain 21 is composed of a malleus 22, an incus 23, and a stapes 24. The stapes 24 is shaped like a "stirrup" with arches 25 and 26 and a stapes footplate 27 which covers the oval window 19. The mobile stapes 24 is supported in the oval window 19 by an annular ligament which attaches the stapes footplate 27 to the solid otic capsule margins of the oval window 19.

FIG. 1 also illustrates the three major components of the hearing aid 10, a microphone 28, a signal-processing amplifier 30 which includes a battery not separately depicted in FIG. 1, and microactuator 32. Miniature cables or flexible printed circuits 33 and 34 respectively interconnect the signal-processing amplifier 30 with the microactuator 32, and with the microphone 28. The PCT Patent Application discloses that the microphone 28 consists of a very thin sheet of biocompatible, and implantable polyvinylidenefluoride ("PVDF")that is identified commercially by a trademark KYNAR®. The microphone 28 disclosed in the PCT Patent Application has an area of approximately 0.5 to 2.0 square centimeter ("$cm^2$"). The PCT Patent Application also discloses that the microphone 28 is preferably to be implanted below the skin in the auricle, or alternatively in the postauricular area of the external ear 13.

The signal-processing amplifier 30 is implanted subcutaneously behind the external ear 13 within a depression 38 surgically sculpted in a mastoid cortical bone 39 of the subject 12. The signal-processing amplifier 30 receives a signal from the microphone 28 via the miniature cable 33, amplifies and conditions that signal, and then re-transmits the processed signal to the microactuator 32 via the miniature cable 34 implanted below the skin in the external auditory canal 14. The signal-processing amplifier 30 processes the signal received from the microphone 28 to optimally match characteristics of the processed signal to the microactuator 32 to obtain the desired auditory response. The signal-processing amplifier 30 may perform signal processing using either digital or analog signal processing, and may employ both nonlinear and highly complex signal processing.

The microactuator 32 transduces the electrical signal received from the signal-processing amplifier 30 into vibrations that either directly or indirectly mechanically vibrate the perilymph fluid 20A in the inner ear 17. As described previously, vibrations in the perilymph fluid 20A actuate the receptor cells 20B to stimulate the auditory nerve fibers 20C which signal the brain of the subject 12 to perceive the mechanical vibrations as sound.

FIG. 1 depicts the relative position of the microphone 28, the signal-processing amplifier 30 and the microactuator 32 with respect to the external ear 13. Even though the signal-processing amplifier 30 is implanted subcutaneously, the subject 12 may control the operation of the hearing aid 10 using techniques analogous to those presently employed for controlling the operation of miniaturized external hearing aids. Both the microphone 28 and the microactuator 32 are so minuscule that their implantation requires little or no destruction of the tissue of the subject 12. Of equal importance, the microphone 28 and the signal-processing amplifier 30 do not interfere with the normal conduction of sound through the ear, and thus will not impair hearing when the hearing aid 10 is turned off or not functioning.

The PCT Patent Application provides a more detailed description of a signal-processing amplifier 30 and a microactuator 32 that are suitable for use in the present invention. Accordingly, the PCT Patent Application is hereby incorporated by reference as though fully set forth herein.

II Implantable Microphone

Figure 2A:
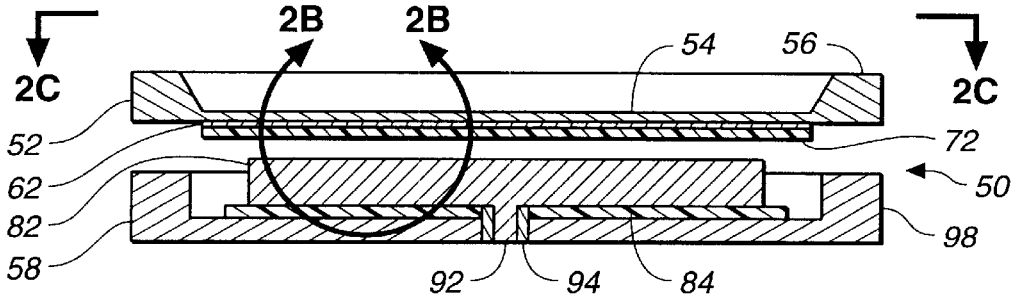
FIG. 2*a* is an exploded, cross-sectional elevational view illustrating an electret microphone in accordance with the present invention including a diaphragm, an electret, a plate that contacts a surface of the electret, and a hermetically sealed housing that encloses the electret and plate.

FIG. 2*a* depicts an exploded, cross-sectional, elevational view of an implantable microphone 50 in accordance with the present invention. The implantable microphone 50 includes a diaphragm 52 preferably formed from a sheet of biocompatible metallic material such as titanium that is one to two mils thick. A central region 54 of the diaphragm 52 is lithographically etched to a thickness of approximately 5 to 12 microns. An outside rim 56, that surrounds the central region 54, is left thicker for ease of attachment to a housing 58 also included in the implantable microphone 50. The housing 58 is also preferably fabricated from a biocompatible material such as titanium. A sealing layer 62 may be applied to a surface of the diaphragm 52 nearest to the housing 58. The sealing layer 62 preferably consists of a thin layer of sputtered chromium, a few hundred angstroms thick, that is overcoated by a thicker layer of gold. This sealing layer 62, that is one to several microns thick, covers any potential cracks or pinholes in the thin central region 54 of the diaphragm 52.

Figure 2B:
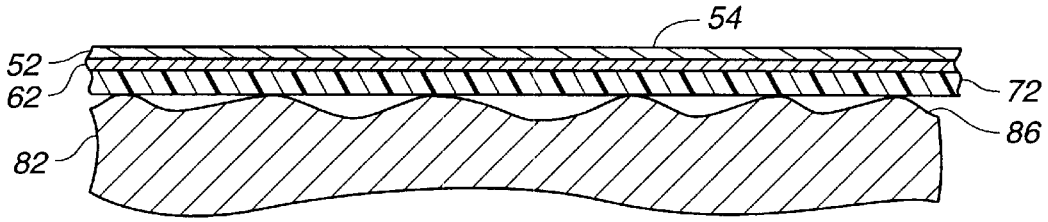
FIG. 2*b* is an enlarged cross-sectional elevational view taken along the line 2*b*—2*b* of FIG. 2*a* illustrating contact between the electret and the plate.
Figure 2C:
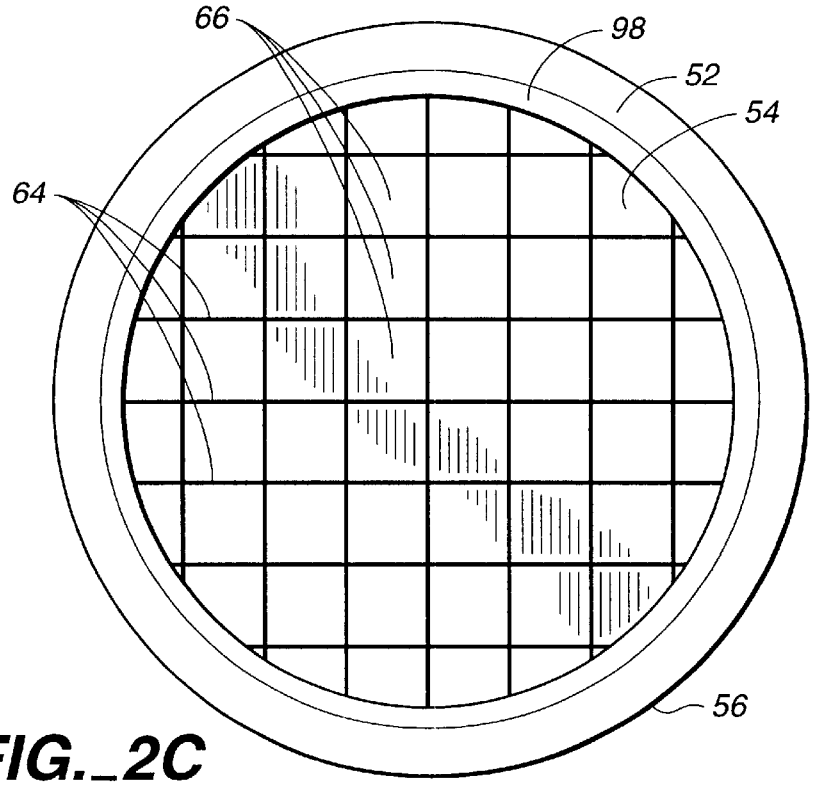
FIG. 2*c* is a plan view taken along the line 2*c*—2*c* of FIG. 2*a* illustrating the diaphragm and reinforcing ribs that subdivide a thinned central region of the diaphragm.

Etching of the diaphragm 52 may be patterned to produce a grid of intersecting reinforcing ribs 64, depicted in FIG. 2*c*, that protrude from a surface of the central region 54 furthest from the housing 58. The reinforcing ribs 64 subdivide the central region 54 into a plurality of separate membranes 66 that are mechanically supported by the reinforcing ribs 64.

After fabricating the diaphragm 52 with its sealing layer 62, a sheet 72 of an electret material having a metalized surface, such as a 0.5 mil thick Teflon film, is thermally bonded to the sealing layer 62 with the metalized side of the sheet 72 contacting the diaphragm 52. A surface of the sheet 72 furthest from the diaphragm 52 is then polarized by corona charging or electron bombardment.

The assembly formed by the diaphragm 52 carrying the bonded electret sheet 72 is then pressed against an electrically conductive plate 82 disposed within the housing 58. An electrically insulating layer 84 is interposed between the plate 82 and the housing 58. As depicted in FIG. 2*b*, the plate 82 either has a naturally rough surface 86 that is juxtaposed with the electret sheet 72, or the surface 86 may be formed with a knurled or other controlled roughness. A contact 92 of an electrical connector 94 that pierces the housing 58 couples via the miniature cables 33 an input signal from the implantable microphone 50 to the signal-processing amplifier 30 included in the hearing aid 10.

The thickness of plate 82 and of the layer 84 are chosen so the surface 86 of the plate 82 protrudes slightly above a rim 98 of the housing 58. The outside rim 56 of the diaphragm 52 is welded to the rim 98 of the housing 58. Because the surface 86 of the plate 82 protrudes above the rim 98 of the housing 58, welding the outside rim 56 to the rim 98 places the diaphragm 52 and the electret sheet 72 under tension, and presses the sheet 72 into contact with the plate 82 at many points, as illustrated in FIG. 2*b*. Acoustic waves impinging upon the central region 54 deflect the electret sheet 72 to thereby generate charges on the plate 82 that constitute an output signal from the implantable microphone 50. The housing 58 forms one electrode of the implantable microphone 50 while the contact 92 forms the other.

Figure 3A:
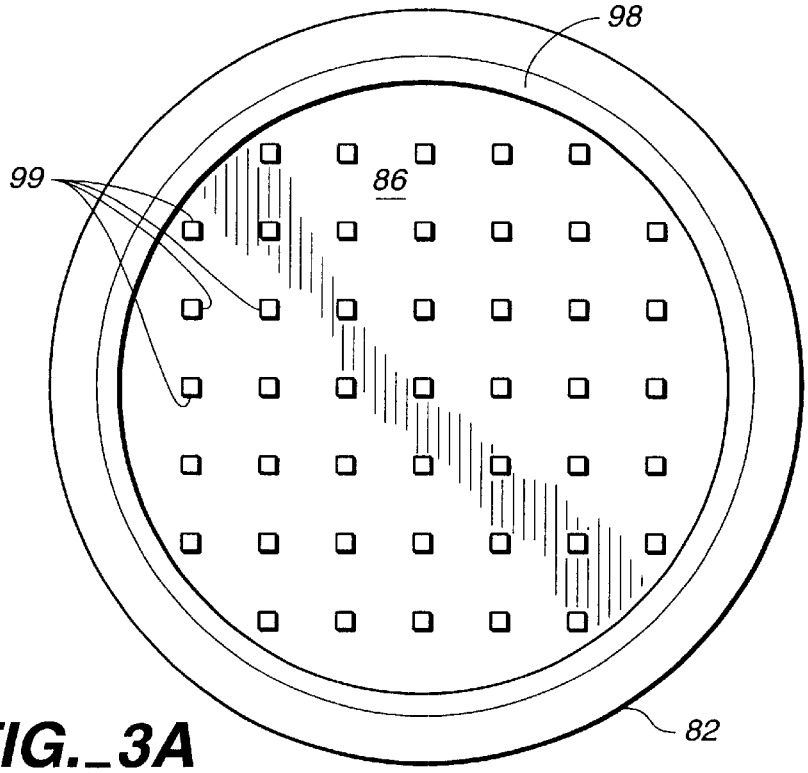
FIG. 3*a* is a plan view of an alternative embodiment structure for the plate depicted in the cross-sectional view of FIG. 2*a;*
Figure 3B:
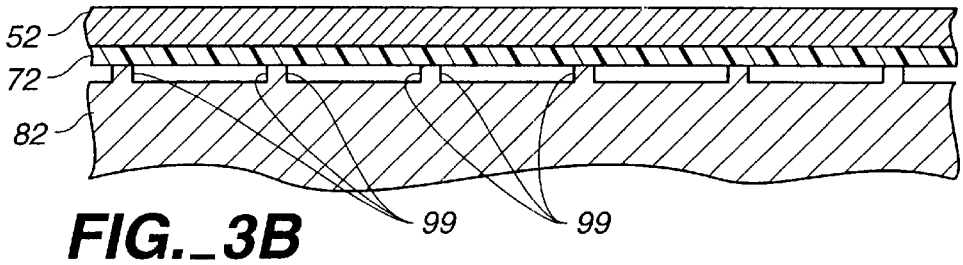
FIG. 3*b* is a cross-sectional view, similar to the view of FIG. 2*b*, of the alternative embodiment structure for the plate depicted in the plan view of FIG. 3*a;*

FIGS. 3*a* and 3*b* depict an alternative embodiment for the plate 82. The embodiment of the plate 82 depicted in those FIGS. includes an array of lithographically defined posts 99 which establish a controlled roughness for the surface 86 of the plate 82 contacting the sheet 72. The posts 99, which are spaced 100 to 1000 microns apart, are formed by etching the surface 86 of the plate 82 to a depth between a few and 100 microns.

The diameter of housing 58 may range from 5.0 mm to 25 mm, but for acoustical reasons preferably does not exceed 10.0 mm in diameter. The hermetically sealed implantable microphone 50 may be implanted subcutaneously, e.g. behind the external ear 13, with the central region 54 of the diaphragm 52 in intimate contact with skin 108 overlying the mastoid cortical bone 39 for minimal attenuation of sound. The implantable microphone 50 is rugged and can take direct blows.

Figure 4:
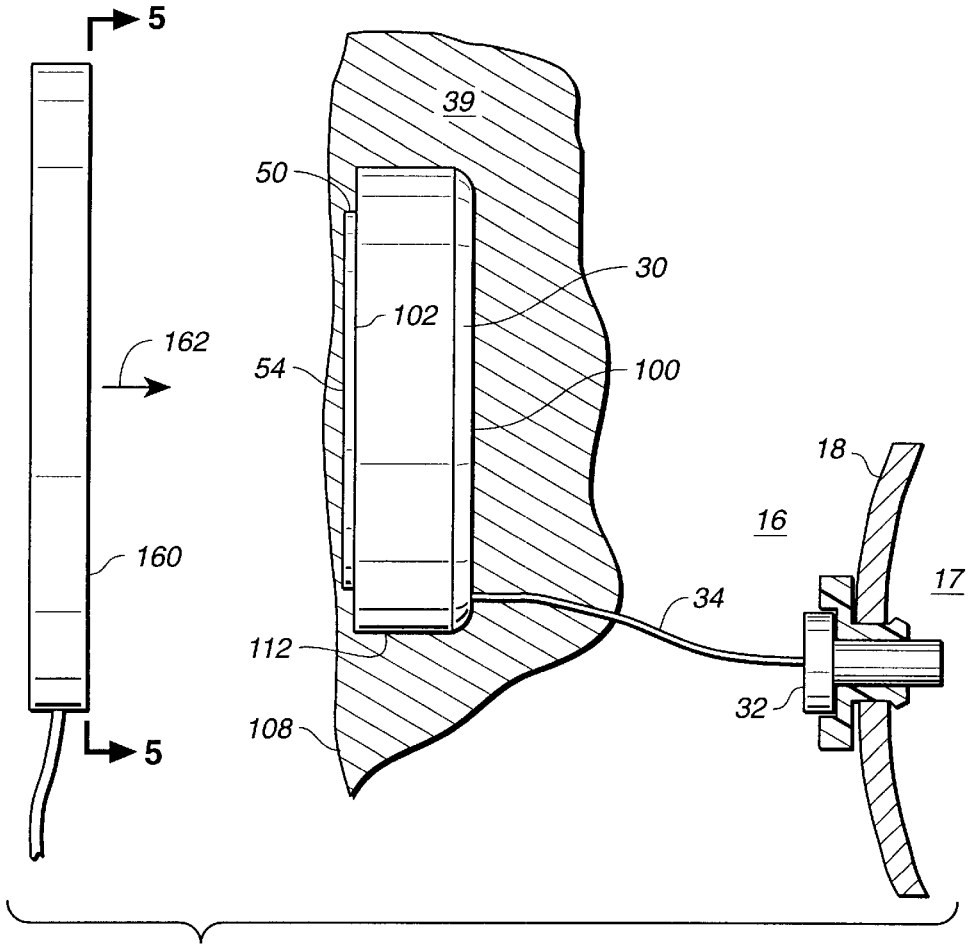
FIG. 4 is a cross-sectional elevational view illustrating implantation into a cavity sculpted into a mastoid bone located behind the ear of an electronics module that includes an electret microphone, an amplifier and battery for energizing operation of the fully implantable hearing aid system.

The implantable microphone 50 described above may be combined with the signal-processing amplifier 30 to provide a disk-shaped, integrated electronics module 100 for the hearing aid 10, as illustrated in FIG. 4. Integrating both the signal-processing amplifier 30 and the implantable microphone 50 into the electronics module 100 as illustrated in FIG. 4 places the implantable microphone 50 on a side of the electronics module 100. Disposed in this location, the housing 58 and diaphragm 52 of the implantable microphone 50 now form part of a wall 102 of the electronics module 100, and the miniature cable 33 depicted in FIG. 1 passes directly between the implantable microphone 50 and the signal-processing amplifier 30 internally within the electronics module 100. The electronics module 100 essentially eliminates the miniature cable 33 connecting the implantable microphone 50 to the signal-processing amplifier 30 together with any possibility of its failure.

For a hearing aid 10 having an integrated electronics module 100, as described in the PCT Patent Application the electronics module 100 carrying both the signal-processing amplifier 30 and the implantable microphone 50 may be implanted subcutaneously behind the external ear 13 of the subject 12 within the depression 38 surgically sculpted in the mastoid cortical bone 39. The depression 38, surgically sculpted to accept a biocompatible, metallic sleeve 132 that receives the electronics module 100, should not be more than 5 mm deep, and should be formed with rounded corners to avoid concentrating stress at sharp corners that would weaken the mastoid cortical bone 39. The sleeve 132 is permanently secured in the depression 38 to facilitate removing and/or replacing the electronics module 100. Disposing the electronics module 100 in this location leaves only the miniature cable 34 that couples an output signal from the signal-processing amplifier 30 to the microactuator 32.

The diaphragm 52 and the housing 58 of the implantable microphone 50 as well as a disk-shaped housing 112 for the electronics module 100 is typically made of biocompatible metals such as titanium, titanium alloys or stainless steel.

The disk-shaped housing 112 may have a diameter of 1.0 to 3.0 cm, and a height typically of 0.5 to 1.0 cm to accommodate the amplifier's electronics and the battery. Even if the housing 112 for the electronics module 100 were an elongated cylinder rather than disk-shaped, a cylindrically-curved wall 102 can still incorporate the implantable microphone 50. Under such circumstances, the central region 54 of the diaphragm 52 has the same curvature as that of the cylindrically-curved wall 102.

Figure 5:
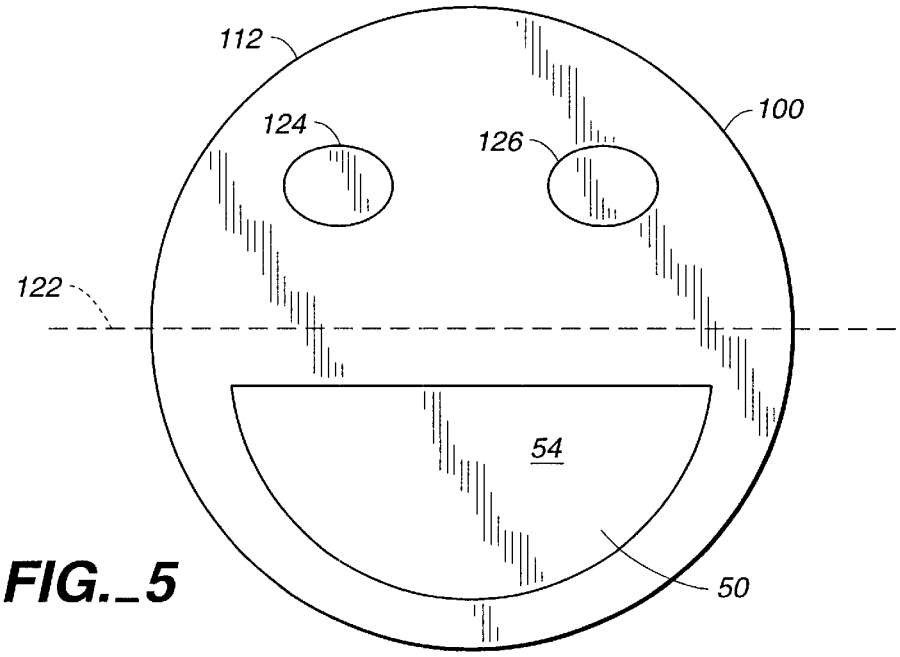
FIG. 5 is an elevational view of a disk-shaped implantable electronics module taken along a line 4—4 in FIG. 3 that illustrates a preferred arrangement for the electronics module, and indicates a preferred vertical location for its implantation on the mastoid bone.

FIG. 5 is a plan view depicting another embodiment of the electronics module 100 adapted for implantation as described above in connection with FIG. 4. It appears that a preferred location for implanting the electronics module 100 exist with the implantable microphone 50 located below a temporal line 122 on the subject 12. This location provides for relatively thin skin 108 over the implantable microphone 50 in the lower half of the electronics module 100, and for thicker skin 108 over the upper part of the electronics module 100. An on-off pressure switch 124 may be located on the housing 112 of the electronics module 100 above the temporal line 122 together with a pressure volume-control 126. Disposed in this location, the subject 12 may control operation of the hearing aid 10 by pressing on the skin 108 overlying the on-off pressure switch 124 and the pressure volume-control 126.

Figure 6:
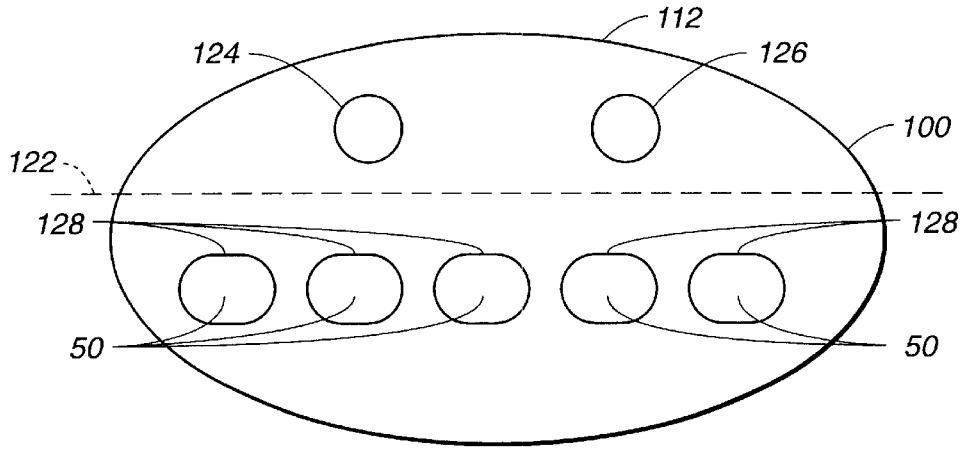
FIG. 6 is an elevational view of an alternative embodiment of an oval-shaped implantable electronics module, similar to the disk-shaped electronics module depicted in FIG. 5, that includes a plurality of microphones.
Figure 7:
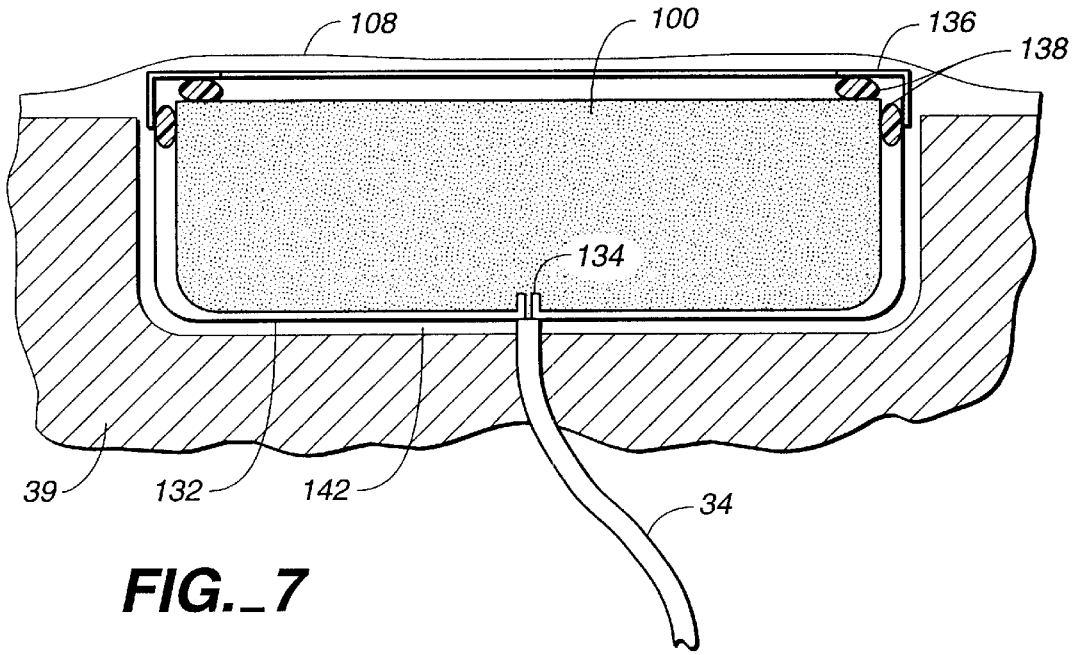
FIG. 7 is a partial cross-sectional view depicting a permanently implanted sleeve adapted to receive and facilitate replacement of the electronics module such as those depicted in FIGS. 4, 5 and 6.

FIG. 6 depicts an oval-shaped alternative embodiment of the electronics module 100 depicted in FIG. 5. The embodiment depicted in FIG. 6 includes a acoustic array 128 of individual implantable microphones 50 arranged in a horizontal row across the electronics module 100. As described in greater detail in U.S. patent application Ser. No. 08/801,056 entitled "Improved Biocompatible Transducers" filed Feb. 14, 1997, and in Patent Cooperation Treaty ("PCT") International Patent Application PCT/US97/02323 having the same title and filing date ("the Improved Biocompatible Transducers patent applications"), an appropriately adapted signal-processing amplifier 30 sums independently generated signals from the implantable microphones 50, applying appropriate weighing factors to the signal from each implantable microphone 50, to produce a desired characteristic sensitivity pattern from the array 128. In this way the hearing aid 10 can provide the subject 12 with directivity which the subject 12 may use to enhance the sounds of interest while concurrently reducing noise. The Improved Biocompatible Transducers patent applications are hereby incorporated by reference.

At 5000 Hz, the wavelength of sound in air is only 6.8 cm. Providing a directional array that is one-half wavelength long at 5000 Hz requires that the array 128 be only a few centimeters long. output signals from each of the implantable microphones 50 of the array 128 are then coupled to the signal-processing amplifier 30. The signal-processing amplifier 30 appropriately weighs the output signals from each of the implantable microphones 50 with a pre-established distribution to produce a directional pattern for the sound perceived by the subject 12. Implanting the array 128 on the mastoid cortical bone 39 of the subject 12 near the external ear 13 provides such a directional sound receiving pattern. By directing the maximum sensitivity of the array 128 toward sounds of interest, it is readily apparent that the subject 12 may use the radiation pattern to advantage in improving reception of such sounds, and to reject noise.

With the configurations for the electronics module 100 depicted in FIGS. 4, 5 and 6, the electronics module 100 is preferably received into the sleeve 132 that is permanently implanted (e.g. tapped) into the mastoid cortical bone 39 of the subject 12. An outer surface of the permanently implanted sleeve 132 may contain ridges 80–130 micron deep to encourage post-implantation growth of bone to lock the housing 112. The permanently implanted sleeve 132 includes a center post 134 that provides a permanent connection for the miniature cable 34 from the microactuator 32. The electronics module 100 is retained within he sleeve 132 by a locking ring 136, and O-rings 138 seal between the electronics module 100 and both the sleeve 132 and the locking ring 136. The O-rings 138 block entry of body fluids into any gap 142 between the electronics module 100 and the sleeve 132. Moreover, the gap 142 may be filled with an electrically insulating biocompatible gel material preferably having a cohesive strength that exceeds the material's adhesive strength with the outer surface of the electronics module 100, the sleeve 132 and the center post 134.

Figure 8:
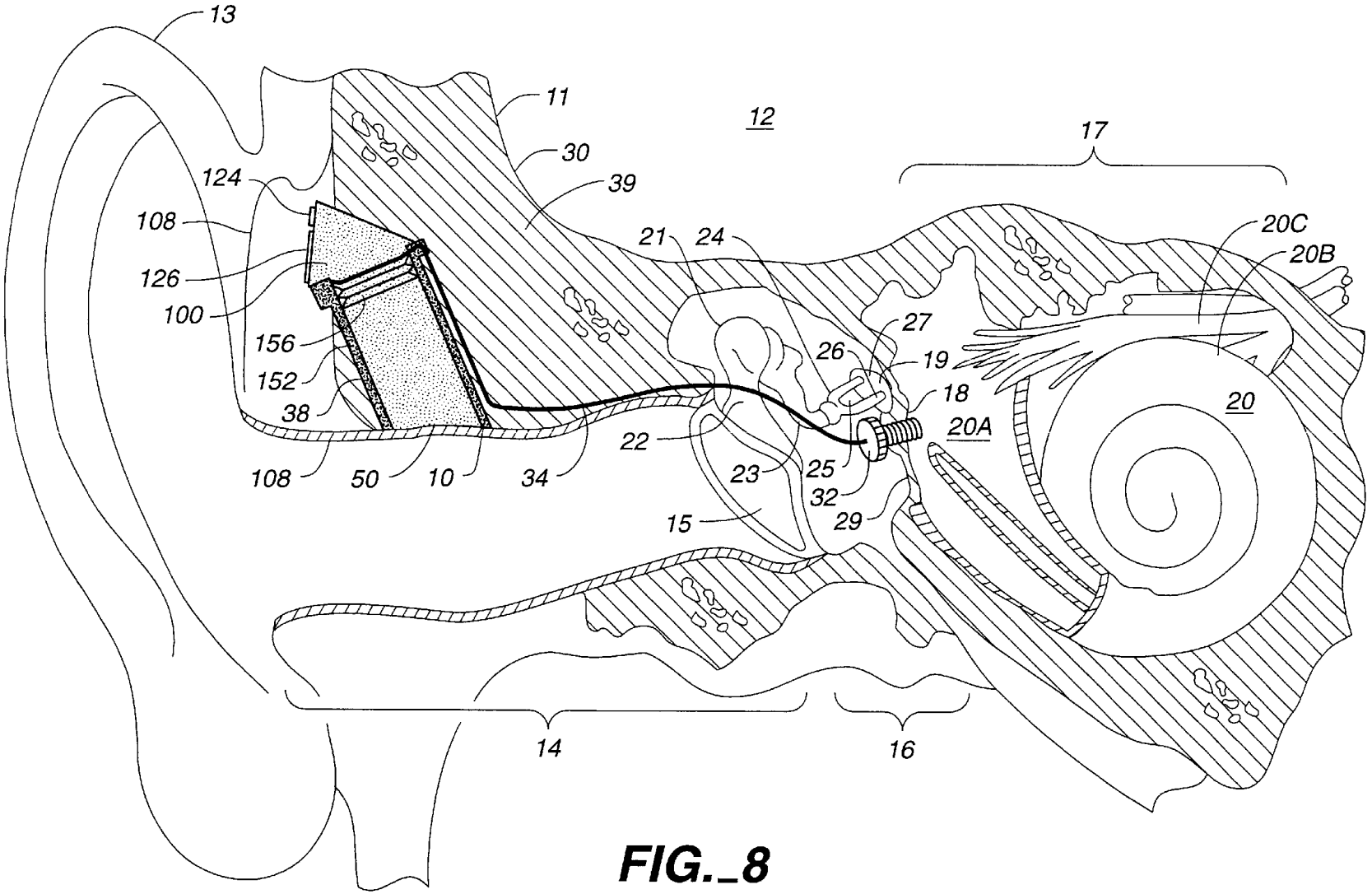
FIG. 8 is a schematic coronal, partial sectional view through a human temporal bone, similar to the partial sectional view of FIG. 1, illustrating implantation into a cavity sculpted there of an electronics module that includes an amplifier, a battery, and a microphone which presses against the skin of the external auditory canal.
Figure 9:
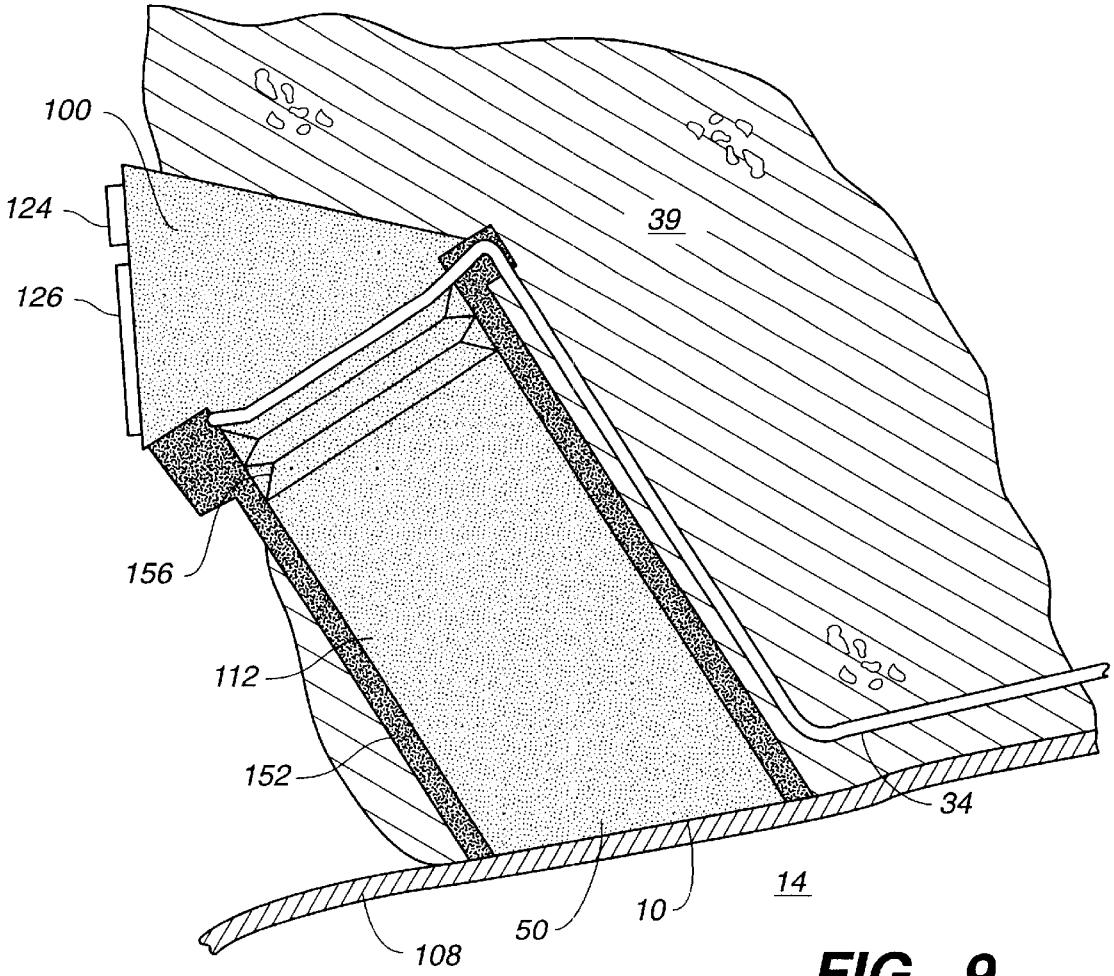
FIG. 9 is an enlarged cross-sectional view of a sleeve preferably used for supporting the electronics module when implanted as depicted in FIG. 8.

If the electronics module 100 is cylindrically-shaped rather disk-shaped, then the implantable microphone 50 may be preferably disposed at another location on the housing 112. For such a configuration of the electronics module 100, as illustrated in FIG. 8 the implantable microphone 50 is preferably located at one end of the cylindrically shaped housing 112. Such a cylindrically-shaped electronics module 100 is preferably implanted subcutaneously with the implantable microphone 50 located adjacent to the skin 108 of the external auditory canal 14 or adjacent to the conchal cartilage in the posterior external auditory canal 14. Disposed in such a location, the implantable microphone 50 presses downward against the skin 108 of the external auditory canal 14 as illustrated in FIG. 8, or against the conchal cartilage. The diaphragm 52 of the implantable microphone 50 may be domed outward to improve contact with the skin 108 or the conchal cartilage. Disposing the implantable microphone 50 in contact with skin 108 or the conchal cartilage of the external auditory canal 14 benefits from a substantial enhancement of sound waves at the implantable microphone 50 provided by the external ear 13. The housing 112 is made long enough so controls are available through the skin 108 at the end of the housing 112 distal from the implantable microphone 50. As illustrated in FIG. 9, a biocompatible, metallic support sleeve 152 is preferably permanently anchored to the mastoid cortical bone 39 to receive the cylindrically-shaped electronics module 100, to facilitate its replacement, and to provide a fixed attachment for the electronics module 100. The housing 112 of the electronics module 100 is encircled by corrugated bellows 156 to accommodate anatomical differences by adjusting the length of the electronics module 100, and to facilitate installing the electronics module 100. Implanted in this way, the implantable microphone 50 is protected from direct blows which permits using types of microphones other than the electret implantable microphone 50.

Referring back to FIG. 4, with the electronics module 100 implanted subcutaneously behind the external ear 13 of the subject 12 the electronics module 100 may be adapted for non-contact recharging of an energy storage device such as a battery, or equivalently a super capacitor, which powers operation of the hearing aid 10. Such non-contact recharging can be effected by disposing an induction coil 160 adjacent to the skin 108 covering the electronics module 100 as indicated by an arrow 162 in FIG. 4.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A sealed, implantable electronics module adapted for inclusion in an implantable hearing aid system, the electronics module comprising:

a microphone;

an amplifier for receiving an input signal from said microphone, and for providing an output signal to a microactuator also included in the implantable hearing aid system;

an energy storage device for powering operation of the implantable hearing aid system;

a disk-shaped housing for receiving and hermetically enclosing said microphone, said amplifier and said energy storage device, said disk-shaped housing being adapted for implantation into a depression surgically sculpted into a mastoid cortical bone behind an external ear of a subject, disposed in this location said microphone is adapted to press against skin overlying said mastoid cortical bone; and an electrical connector coupled to said amplifier for providing the output signal to the microactuator of the implantable hearing aid system.

2. The electronics module of claim 1 wherein said electronics module is adapted to be mechanically received by and electrically coupled to a sleeve that is included in the implantable hearing aid system, the electrical coupling of the electronics module to the sleeve providing the output signal from said amplifier to the microactuator, said sleeve being adapted for permanent implantation into a subject to thereby facilitate replacement of said electronics module.

3. The electronics module of claim 1 wherein said microphone includes:

a diaphragm having a thin central region surrounded by a thicker rim;

an electret bonded to said diaphragm;

a roughened plate contacted by said electret; and said housing receiving said plate and said electret, said housing being electrically insulated from said plate, the rim of said diaphragm being bonded to a surface of said housing thereby hermetically sealing the microphone, and said plate and said electret providing the input signal to the amplifier.

4. The electronics module of claim 1 wherein said electronics module is further adapted to permit non-contact recharging of said energy storage device that energizes operation of the implantable hearing aid system.

5. The electronics module of claim 1 having an array of microphones, each microphone included in said array of microphones, in response to impingement of sound waves upon a subject, independently generating an electrical signal that is received by said amplifier which combines the electrical signals received from the array of microphones to produce a desired characteristic sensitivity pattern for the array of microphones.

6. The electronics module of claim 1 wherein said electronics module is disk-shaped and adapted for implantation into a depression surgically sculpted into a mastoid cortical bone behind an external ear of a subject, disposed in this location said microphone is adapted to press against skin overlying said mastoid cortical bone.

7. The electronics module of claim 1 wherein said microphone includes:

a diaphragm having a thin central region surrounded by a thicker rim;

an electret bonded to said diaphragm;

a roughened plate contacted by said electret; and said housing receiving said plate and said electret, said housing being electrically insulated from said plate, the rim of said diaphragm being bonded to a surface of said housing thereby hermetically sealing the microphone, and said plate and said electret providing the input signal to the amplifier.

8. The electronics module of claim 1 wherein said electronics module is cylindrically-shaped and adapted for implantation into a depression surgically sculpted into a mastoid cortical bone of a subject, disposed in this location said microphone is adapted to press against skin or conchal cartilage of an external auditory canal.

9. The electronics module of claim 1 wherein said electronics module is further adapted to permit non-contact recharging of said energy storage device that energizes operation of the implantable hearing aid system.

10. The electronics module of claim 1 having an array of microphones, each microphone included in said array of microphones, in response to impingement of sound waves upon a subject, independently generating an electrical signal that is received by said amplifier which combines the electrical signals received from the array of microphones to produce a desired characteristic sensitivity pattern for the array of microphones.

11. A hearing aid system that is adapted for implantation into a subject whose body has a head that includes a bony otic capsule which encloses a fluid-filled inner ear; the hearing aid system including:

a microactuator adapted for implantation in the subject in a location from which a transducer included in said microactuator may mechanically generate vibrations in the fluid within the inner ear of the subject, the microactuator receiving an electrical driving signal and producing vibrations in the fluid within the inner ear responsive to the received electrical driving signal; and a sealed, implantable electronics module including:

a microphone;

an amplifier for receiving an input signal from said microphone, and for providing the electrical driving signal to said microactuator;

an energy storage device for powering operation of the hearing aid system; and a disk-shaped housing for receiving and hermetically enclosing said microphone, said amplifier and said energy storage device, said disk-shaped housing being adapted for implantation into a depression surgically sculpted into a mastoid cortical bone behind an external ear of a subject, disposed in this location said microphone is adapted to press against skin overlying said mastoid cortical bone.

12. The hearing aid system of claim 11 wherein said electronics module is adapted to be mechanically received by and electrically coupled to a sleeve that is included in the implantable hearing aid system, the electrical coupling of the electronics module to the sleeve providing the electrical driving signal from said amplifier to the microactuator, said sleeve being adapted for permanent implantation into a subject to thereby facilitate replacement of said electronics module.

13. The hearing aid system of claim 11 wherein said electronics module has an array of microphones, each microphone included in said array of microphones, in response to impingement of sound waves upon a subject, independently generating an electrical signal that is received by said amplifier which combines the electrical signals received from the array of microphones to produce a desired characteristic sensitivity pattern for the array of microphones.

14. The hearing aid system of claim 11 wherein said electronics module has an array of microphones, each microphone included in said array of microphones, in response to impingement of sound waves upon a subject, independently generating an electrical signal that is received by said amplifier which combines the electrical signals received from the array of microphones to produce a desired characteristic sensitivity pattern for the array of microphones.

15. A sealed, implantable electronics module adapted for inclusion in an implantable hearing aid system, the electronics module comprising:

a microphone;

an amplifier for receiving an input signal from said microphone, and for providing an output signal to a microactuator also included in the implantable hearing aid system;

an energy storage device for powering operation of the implantable hearing aid system;

a housing for receiving and hermetically enclosing said microphone, said amplifier and said energy storage device; and a sleeve adapted:

a) for receiving said housing;

b) for coupling the output signal between said amplifier and the microactuator; and c) for permanent implantation into a subject to thereby facilitate replacement of said electronics module.

16. A hearing aid system that is adapted for implantation into a subject whose body has a head that includes a bony otic capsule which encloses a fluid-filled inner ear; the hearing aid system including:

a microactuator adapted for implantation in the subject in a location from which a transducer included in said microactuator may mechanically generate vibrations in the fluid within the inner ear of the subject, the microactuator receiving an electrical driving signal and producing vibrations in the fluid within the inner ear responsive to the received electrical driving signal; and a sealed, implantable electronics module including:

a microphone;

an amplifier for receiving an input signal from said microphone, and for providing the electrical driving signal to said microactuator;

an energy storage device for powering operation of the hearing aid system; and a housing for receiving and hermetically enclosing said microphone, said amplifier and said energy storage device; and a sleeve adapted:

a) for mechanically receiving said housing;

b) for coupling the output signal between said amplifier and the microactuator; and c) for permanent implantation into a subject to thereby facilitate replacement of said electronics module.

* * * * *